US010307927B2

(12) United States Patent
Mayer et al.

(10) Patent No.: US 10,307,927 B2
(45) Date of Patent: Jun. 4, 2019

(54) DEVICE AND METHOD FOR CUTTING UP FOOD PRODUCTS

(71) Applicant: Textor Maschinenbau GmbH, Wolfertschwenden (DE)

(72) Inventors: Josef Mayer, Memmingerberg (DE); Mathias Salmen, Wiggensbach (DE); Jorg Schmeiser, Wiggensbach (DE); Wilfried Maier, Probstried (DE); Holger Herzberger, Ebsdorfer Grund (DE)

(73) Assignee: TEXTOR MASCHINENBAU GMBH, Wolfertschwenden (DE)

( * ) Notice: Subject to any disclaimer, the term of this patent is extended or adjusted under 35 U.S.C. 154(b) by 168 days.

(21) Appl. No.: 14/421,347

(22) PCT Filed: Jul. 30, 2013

(86) PCT No.: PCT/EP2013/066030
§ 371 (c)(1),
(2) Date: Feb. 12, 2015

(87) PCT Pub. No.: WO2014/029590
PCT Pub. Date: Feb. 27, 2014

(65) Prior Publication Data

US 2015/0202786 A1 Jul. 23, 2015

(30) Foreign Application Priority Data

Aug. 20, 2012 (DE) ..... 10 2012 214 741

(51) Int. Cl.
*B26D 7/32* (2006.01)
*B26D 7/02* (2006.01)
(Continued)

(52) U.S. Cl.
CPC ..... *B26D 7/0625* (2013.01); *B26D 7/01* (2013.01); *B26D 7/02* (2013.01); *B26D 7/06* (2013.01);
(Continued)

(58) Field of Classification Search
CPC ..... B26D 2210/02; B26D 7/01; B26D 7/02; B26D 7/06; B26D 7/0625; B26D 7/0683; Y10T 83/6572
See application file for complete search history.

(56) References Cited

U.S. PATENT DOCUMENTS 1,976,825 A 10/1934 Ahrndt
2,038,770 A 4/1936 Straeten
(Continued)

FOREIGN PATENT DOCUMENTS

DE 3018446 A1 11/1981
DE 102007063112 A1 7/2009
(Continued)

OTHER PUBLICATIONS

International Preliminary Report on Patentability for International application No. PCT/EP2013/066030 dated Mar. 5, 2015.
(Continued)

*Primary Examiner* — Stephen Choi
(74) *Attorney, Agent, or Firm* — Cantor Colburn LLP

(57) ABSTRACT

A device for cutting up food products, particularly a high-performance slicer, having a product feed which comprises at least one conveying device. At least one product may be fed to a cutting plane in which at least one cutting tool is moving, particularly in a rotating or circulating manner. The cutting device further comprises at least one multifunctional working unit for at least intermittently handling the product. The working unit can be displaced into a contact position, in which the working unit presses the product which is mov-
(Continued)

Figure 1:
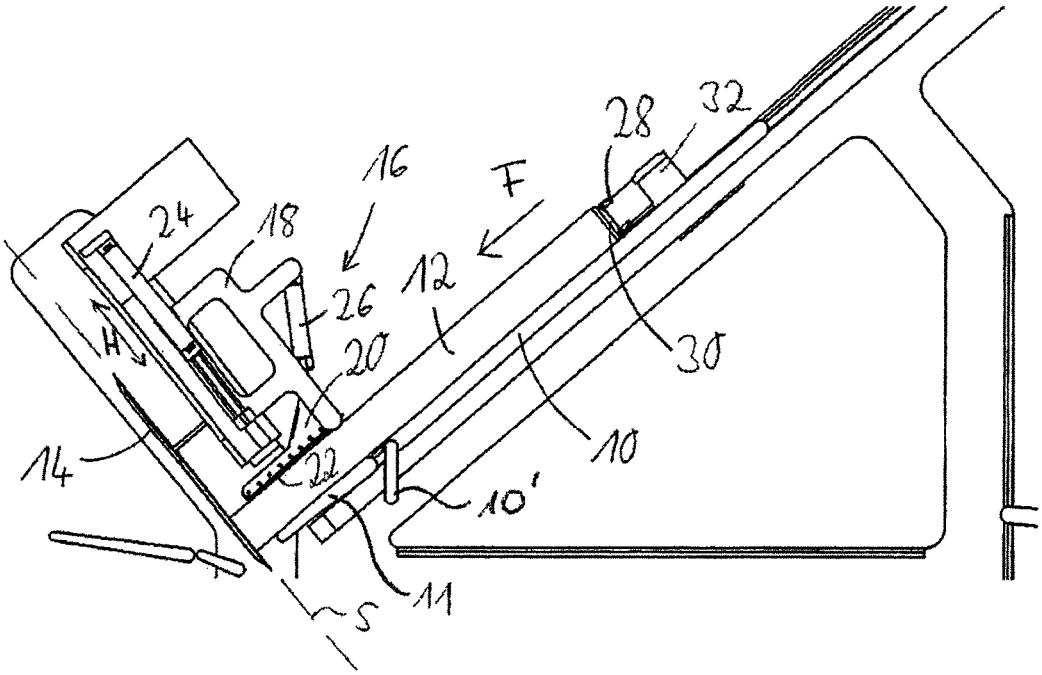

able in the conveying direction against a lower product bearing surface and/or a side product bearing surface, and into a locking position. In the locking position, the working unit prevents any movement of the product in the conveying direction.

21 Claims, 3 Drawing Sheets

(51) Int. Cl.
*B26D 7/06* (2006.01)
*B26D 7/01* (2006.01)

(52) U.S. Cl.
CPC ..... *B26D 7/0683* (2013.01); *B26D 2210/02* (2013.01); *Y10T 83/04* (2015.04); *Y10T 83/6572* (2015.04)

(56) References Cited

U.S. PATENT DOCUMENTS

| | | | | |
|---|---|---|---|---|
| 2,768,666 | A | 10/1956 | Garapolo et al. | |
| 3,354,920 | A | 11/1967 | Hertwig | |
| 4,309,927 | A | 1/1982 | Dennis et al. | |
| 4,329,900 | A * | 5/1982 | Dennis | B26D 7/06 83/355 |
| 4,548,108 | A * | 10/1985 | Dennis | B26D 5/32 83/13 |
| 5,079,982 | A * | 1/1992 | Antonissen | B26D 7/0625 198/626.5 |
| 5,271,304 | A | 12/1993 | Wygal et al. | |
| 5,481,466 | A * | 1/1996 | Carey | A22C 17/002 700/167 |
| 2006/0196328 | A1 | 9/2006 | Pryor et al. | |
| 2009/0120256 | A1 | 5/2009 | Pasek | |

FOREIGN PATENT DOCUMENTS

| | | | |
|---|---|---|---|
| DE | 102008019776 | A1 | 10/2009 |
| DE | 102012214741 | A1 | 2/2014 |
| EP | 0931630 | A2 | 7/1999 |
| EP | 1958741 | A1 | 8/2008 |
| EP | 2239108 | A2 | 10/2010 |
| GB | 538919 | | 8/1941 |
| JP | H10337691 | A | 12/1998 |
| JP | 2000288984 | A | 10/2000 |
| WO | 2010011237 | A1 | 1/2010 |

OTHER PUBLICATIONS

Search Report regarding related EP App. No. 17206542.7; dated May 16, 2018; 3 pgs.

* cited by examiner

DEVICE AND METHOD FOR CUTTING UP FOOD PRODUCTS

CROSS-REFERENCES TO RELATED APPLICATIONS

This application is a National Phase Application of Patent Application PCT/EP2013/066030, filed on Jul. 30, 2013, which claims priority to German patent application no. 102012214741.1, filed on Aug. 20, 2012, both of which are incorporated herein by reference, in their entirety.

The invention relates to an apparatus for slicing food products, in particular to high-performance slicers, having a product feed which comprises at least one conveying device by which at least one product can be fed to a cutting plane in which at least one cutting blade moves, in particular in a rotating and/or revolving manner.

The cutting blade can, for example, be a scythe-like blade, an orbital blade or a circular blade.

With such slicing apparatus, a food product is conveyed to a rotating blade with a defined speed profile. In this respect, the blade cuts off slices from the food product. The slice thickness is defined by the feed speed of the food product relative to the speed of rotation of the cutting blade which can amount to several hundred to some thousand revolutions per minute.

To ensure that the product is conveyed at a speed predefined by a precision drive, traction systems are e.g. used, i.e. the product is conveyed by one or more driven rollers or belts. A product can thereby ideally be transported without slip. Two parallel conveyor belts can thus, for example, be provided for each product, in particular beneath and above the product, and the product is conveyed between them.

If only a lower conveyor belt is used for transporting the product or if an upper conveyor belt does not come close enough to the cutting plane, an upper holding-down system can be provided in this respect which presses the product onto the lower conveyor belt. The holding-down system in this respect in particular has the task of stabilizing the product on the entry and exit of the cutting blade.

A plurality of food products, in particular arranged next to one another, can also be simultaneously fed to one cutting plane. The food products can there be sliced by a common cutting blade or can be sliced by a plurality of individual cutting blades.

The product feed can in this respect be controlled individually per track. Each track can thus e.g. be equipped with its own conveying device, in particular with a continuous belt conveyor and/or a product holder.

A product conveying individually per track, however, has the disadvantage with a plurality of products that the respective product holders, which are grippers, for example, have to be controlled individually. This requires a complex and expensive servo technology.

Alternatively, a common conveying device can also be provided for all tracks in a less expensive embodiment. In this respect, a plurality of products arranged next to one another are fed to the cutting plane with the aid of a common product feed. In this respect, all product holders are in particular only moved together, i.e. all the product holders respectively engaging at the rear product end are always located at the same position with respect to the conveying direction. The products are in this respect moved in common in all tracks with the aid of the continuous belt conveyor and/or of the product holders.

Once the cutting process has ended, the end piece of the food product located at the product holder typically has to be discarded. The product feed, and thus also the product holder, is as a rule set at a slant, in particular at a feed angle of 30° to 80° with respect to the horizontal, during the cutting process and on the discarding of the end piece.

It has to be avoided on the discarding of the end piece that the end piece falls into the cutting plane after the release of the product holder. A pusher can be provided for this purpose which prevents the end piece from reaching the cutting plane.

On the one hand a downholder for the food product is necessary for an optimum cutting result and, on the other hand, a pusher which prevents a product end piece from reaching the cutting plane is thus necessary in a slicing apparatus.

Such a pusher can also act as an abutment when a new product is manually or automatically inserted into the slicing apparatus. The pusher in this respect prevents a movement of the product to the cutting plane when the product holder engages at the rear product end in the preparation of the cutting process.

A pusher is in particular advantageous if a plurality of food products are to be sliced since then the pusher can simultaneously serve as an abutment for all products. If, however, as occurs as a rule in practice, the products have different lengths and are acted on at their rear ends by a product feed which only moves as a whole, i.e. cannot be operated individually per track, products of different lengths are clamped between the pusher and e.g. individual product holders of the product feed. A longer food product is in this respect compressed more than a shorter food product. This can result in unwanted deformations or even in damage to the products which is to be avoided at all costs.

Such product impairments cannot only occur at multi-track slicing apparatus, but also at those slicing apparatus which only slice one product at a time if, for example, a product holder has to act on the rear product end with a relatively high force, for example due to the product consistence, in the preparation of the cutting process to ensure a sufficiently firm grip.

So that pressure can be taken off the products before the start of the actual cutting process, the product holders can typically be retracted before the pusher is opened after they have come into engagement with the products. This movement of the product fee against the conveying direction slows down the cutting process and thus reduces the achievable product throughput overall.

Not only a downholder which presses the product toward a lower product support can be provided to stabilize and guide the product, but also alternatively or additionally a pressing device which presses the product toward a lateral product contact.

To avoid the aforesaid problems, a slicing apparatus consequently has to be able to satisfy a plurality of functions which are partly independent of one another and which are partly related to one another so that an optimum cutting result and a cutting performance which is as high as possible can be achieved. Such demands are made both on apparatus with which only one product at a time can be sliced and on apparatus which are capable of multi-track operation. The specific manner in which the product feed engages at the product is also not of importance, at least with respect to some demands. The product feed can e.g. have one or more product holders which are configured for example, as product grippers provided with claws or are pure pushers. In addition, it is admittedly usual, but not compulsory, that the product feed engages at the rear product end. The product feed can e.g. also engage laterally or coming from the side at the rear region of the product.

The above-explained problems or demands in the handling of products to be sliced can in principle be managed well with the currently known slicers; however, a relatively high effort in construction and in technical control has to be invested which is accompanied by comparatively high costs.

It is therefore an object of the invention to provide an apparatus and a method for slicing food products which provide an ideal handling of the products with an effort which is as small as possible in construction and in technical control and which in this respect in particular ensure a high cutting quality and allow a high product throughput.

In accordance with the invention, the slicing apparatus comprises at least one multifunctional work unit for the at least time-wise handling of the product, wherein the work unit is adjustable into a contact position, in which the work unit presses the product movable in the conveying direction in this respect toward a lower product support and/or toward a lateral product contact, and into a blocking position.

In the contact position, the work unit can act as a downholder for the product. In this respect, the product can be clamped between the lower product support, in particular a conveyor belt, a roller track or an immobile surface having a low coefficient of static friction, and the work unit.

Alternatively or additionally, the product can also be pressed at a lateral product contact in the contact position, e.g. at a side wall, in particular at a conveyor belt, at a roller track or at an immobile surface having a low coefficient of static friction.

The product is thereby in particular stabilized on the entry and exit of the cutting blade. A slicing of the products into uniform slices is thus e.g. made possible.

In the blocking position, the work unit in contrast acts against a movement of the product in the conveying direction, i.e. in particular the path to the cutting blade is blocked for the product.

The work unit in accordance with the invention thus satisfies a double function and can thus take over those functions which, with known slicers, are satisfied by two devices which are constructionally separate and which are to be operated separately, namely by a product downholder, on the one hand, and by a pusher, on the other hand.

Only a single device is necessary due to this double action, whereby costs can be saved. The construction of the slicing apparatus is moreover particularly simple. Servicing work is also thereby reduced.

Further developments of the invention are set forth in the dependent claims, in the description and in the enclosed drawings.

The work unit can be of passive or active design. A passive work unit can e.g. comprise a bent sheet metal part or a non-driven roller track. With an active work unit, for example, a belt band or driven rollers can be provided. The conveying of the product along and/or against the conveying direction can thereby be assisted in the contact position of the work unit. The discarding of an end piece can also e.g. be actively assisted in the blocking position. With such an active configuration of the work unit, the contact position can simultaneously be a traction position or conveying position since the work unit at least assists the conveying of the product.

In accordance with an embodiment, the work unit located in the blocking position is active in dependence on the operation situation as an abutment for the front product end or as a deflector for a product end piece to be discarded.

If e.g. a new product is inserted, its one end abuts the abutment and its other end is brought into engagement with the product holder. A secure engaging of the product holder, e.g. into the rear product end, can be guaranteed by the abutment. The product is not yet pushed along the conveying direction toward the cutting plane due to the abutment during the engagement of the product holder.

If a product has been almost completely sliced, the work unit can also be active in the blocking position as a deflector for a product end piece to be discarded. It is prevented by the blocking position that the product end piece falls into the cutting plane when it is brought out of engagement with the product holder. This could otherwise, for example, result in unwanted snippet formations and contaminations of the slicing apparatus.

On the deflecting, i.e. removal, of the end piece from the product feed, the end piece can, for example, be transported downwardly into a shaft or laterally out of the conveying path. The work unit can in this respect in particular have a surface which extends vertically or obliquely to the product support to lead off the product end piece. A targeted sliding off or slipping off or removal of the end piece is ensured in this manner.

The work unit can in this respect act passively as a deflector. It is also conceivable to configure the work unit as active, e.g. by means of a driven belt band, whereby the discarding of the end piece is actively assisted. This allows a particularly reliable and fast release of the product feed.

In accordance with a further embodiment, the work unit located in the blocking position is configured as yielding with respect to a force applied in the conveying direction. The work unit is thus in particular not rigid. This can, for example, be realized by an elastic and/or flexible material, e.g. by a rubber material or plastic material. Alternatively or additionally, spring systems or pneumatic and/or hydraulic systems are conceivable, for example. The work unit can in this respect yield uniformly or can be adjusted stepwise—in particular in dependence on the applied force—into different positions. The yield behavior can in this respect in particular be adjustable, e.g. by the material selection, the selection of the spring used or by an adjustment or control or regulation of the pneumatic and/or hydraulic system. It can thereby be regulated whether or by how much the work unit yields in dependence on an acting force.

In accordance with a further embodiment, the work unit located in the blocking position is movable with a component in the conveying direction, in particular against the action of a holding force, by a force which exceeds a threshold and which is applied in the conveying direction. From a specific force action onward, the path for the product is thus released at least a little in the conveying direction. In this respect, spring systems or pneumatic and/or hydraulic systems are conceivable, for example. The work unit can in this respect be moved uniformly or can be adjusted stepwise—in particular in dependence on the applied force—into different positions.

Above all longer products are clamped between the work unit, which is located in the blocking position and is e.g. held in this blocking position with a specific holding force, and the product holders, in particular when a plurality of products of different lengths are brought into engagement with product holders which are only moved together, i.e. not individually per track. Since now at least one component of the work unit can move in the conveying direction, a pressurized product can in particular relax. An excessive load of the product end at the product holder is thereby avoided. The product is also immediately securely held.

Products of different lengths can thus be processed in a simple and secure manner. In addition, there are no disadvantageous compressions of the products. Thanks to these measures, each product so-to-say individually receives as much space as it requires due to its length in order not to be compressed by an excessive amount.

The threshold value and/or the holding force are in particular adjustable. The resistance can e.g. thereby be determined which is opposed to a product. If the pressure is sufficiently high, the blocking position is at least partly or temporarily released and the work unit at least partly releases the path for the product.

In a further development, the movement of the work unit is at least a part of an adjustment movement of the work unit into the contact position. The work unit is thus at least partly adjusted into the contact position by the applied force. The movement due to the exceeding of the threshold value thus in particular already forms the start of the movement for adjusting the work unit from the blocking position into the contact position. Valuable time is hereby saved.

In accordance with a further embodiment, the work unit can be adjusted from the blocking position directly into the contact position and vice versa. No intermediate positions are thus provided, for example. However, it is alternatively also conceivable to move the work unit from the blocking position first into an intermediate position. A further function could, for example, be carried out in this intermediate position. The work unit would only be adjusted into the contact position after this intermediate position. In both cases, the work unit can be permanently in contact with the product during the adjustment movement.

In accordance with a further embodiment, the work unit is adjustable, starting from the blocking position, without a movement component directed against the conveying direction. The work unit is in particular pivotable with a component in the conveying direction into a position releasing the path for the product. In this manner, the product does not first have to be moved against the product feed direction, for example with the aid of the product holder, so that the work unit can be adjusted. Such an adjustment of the work unit, e.g. in the conveying direction or perpendicular from the conveying direction or a lateral movement out of the conveying path, is particularly advantageous. The working speed of the slicing apparatus can thus be increased in this manner, for example, since the product conveying does not have to be interrupted and it is also not necessary to withdraw the product by means of a product holder, i.e. to move it against the conveying direction, before the release of the conveying path.

In accordance with a further embodiment, an adjustment movement of the work unit comprises a pivot movement. A direct adjustment of the work unit from the blocking position into the drive position can be implemented particularly simply in this manner. The work unit can in particular comprise a joint or hinge for this purpose.

In accordance with a further embodiment, the work unit comprises at least one adjustable holding section which exerts a contact function in the contact position and a blocking function for the product in the blocking position. The holding section can in this respect be configured as a passive element, e.g. as a bent sheet metal part or as a non-driven roller track or as an active conveying element, e.g. as a belt band or a driven roller track. The holding section in particular has an at least substantially planar holding surface which faces the product and which preferably extends at least approximately in parallel with the conveying direction in the contact position and at least approximately perpendicular to the conveying direction in the blocking position. In this manner, a contact surface with the product can be provided which is as large as possible both in the contact position and in the blocking position. The holding section can alternatively also have a different geometrical shape.

In the contact position, the holding surface can press the product from above onto a lower product support or from the side toward a product contact.

In accordance with a further embodiment, the position of the work unit, in particular the spacing of the work unit from the lower product support and/or from the lateral product contact, is variable. In this manner, the work unit can, for example, be set to the diameter of the product. The change of position can take place manually, for example by means of adjustable screws or automatically, for example by means of an electrical, electromagnetic, hydraulic and/or pneumatic drive.

In accordance with a further embodiment, an adjustment movement of the work unit and a movement for changing the position of the work unit are independent of one another. The height of the work unit and/or the lateral position of the work unit can thus, for example, be varied independently of the adjustment movement between the contact position and the blocking position. A separate drive is in particular provided for each of these two movements. The work unit can thus be adapted to the respective circumstances, in particular to the product to be sliced, particularly variably and with high precision. It is possible to handle the product securely and in a controlled manner due to the independent drives, which in particular results in an exact guiding of the product and in a good cutting result.

Alternatively, an adjustment movement of the work unit and a movement for changing the position of the work unit are positively coupled to one another. In this respect, a slot guide can be provided, for example. The adjustment movement can in particular comprise a curved section in order additionally to move the work unit from the contact position into the blocking position and vice versa on a change of the position of the work unit. In this manner, different movements are carried out on the basis of a single instigation movement. Such an instigation movement can be realized, for example, by only a single drive, whereby costs can be saved.

In accordance with a further embodiment, the work unit comprises a base and a holding section for the product at the base, with the position of the base being variable and the holding section being adjustable. The holding section is in this respect in particular pivotally connected to the base and can be adjusted in this manner, for example, by pivoting, from a contact position into a blocking position. In addition, the height and/or the lateral spacing of the base relative to the product can be adjusted, for example.

In a further development, the holding section is movable relative to the base. The holding section can in particular be pivoted relative to the base, e.g. with the aid of a joint.

In accordance with a further embodiment, a movement of the base for varying the position and an adjustment movement of the holding section can be effected independently of one another and in particular by means of separate drives. The height and/or the lateral spacing of the base relative to the product can thus, for example, be carried out independently of the adjustment movement of the holding section from the contact position and from the blocking position or vice versa. A particularly precise adaptation of the work unit to the product is thereby ensured.

Alternatively, a movement for changing the position of the base and an adjustment movement of the holding position can be derived from a single movement of the work unit, with in particular the movement of the work unit being effected by means of a single drive. This takes place, for example, with the aid of a slot guide. The adjustment movement can in this respect comprise a curved section. In this manner, for example, a single drive can be sufficient for both adjustment movements. This produces a substantial cost reduction.

In accordance with a further embodiment, the work unit, in particular a holding section of the work unit, is configured as an at least time-wise active drive for the product. The drive unit can in this respect, for example, comprise a belt band or driven rollers. In this manner, the work unit can, for example, assist a belt conveyor, on which the product lies, in the conveying of the product. A driven and thus active work unit can also act in an assisting manner in an end piece discarding.

In a further embodiment, the product feed is configured with multiple tracks to slice a plurality of products simultaneously. In this respect, the work unit can be operated individually per track. The special features, for example the length, width, height, cross-sectional shape, contour, consistence, hardness, density and/or structure, of the respective products can thereby be taken into account individually and independently of one another. It is alternatively also conceivable to provide a common drive unit for a plurality of tracks or for all tracks.

In accordance with a further embodiment, the work unit comprises an adjustable holding section for each track which exerts a contact function in a contact position and a blocking function for the product in a blocking position, with the holding sections being operable independently of one another. In this manner, all tracks can, for example, be blocked independently of one another. The yielding or the threshold value of the work unit can also be adapted individually for each track and for each product.

In accordance with a further embodiment, the holding sections can be attached to a common base of the work unit and can be adjustable relative to the base independently of one another. A flexible adaptation is thereby made possible. All the holding sections and thus all the tracks can thus be influenced centrally via the common base.

In accordance with a further embodiment, the position of the base, in particular its spacing from the lower product support and/or from the lateral product contact, can be varied. The height and/or the lateral position of the base can thus, for example, be set in common for all the tracks or for at least some tracks, whereas the adjustment of the holding sections can take place individually per track between the contact position and the blocking position. Alternatively, the adjustment of the holding sections can also take place independently of one another. In this respect, a common holding section can in particular be provided for all tracks or at least for some tracks.

In accordance with a further embodiment, a respective separate drive is provided for the base and for each of the holding sections. Alternatively, the base and the holding sections can also be operated by a common drive. It is also conceivable to drive at least some holding sections by a common drive.

The invention additionally relates to an apparatus for slicing food products, in particular to high-performance slicers, having a product feed which comprises at least one conveying device by which at least one product can be fed to a cutting plane in which at least one cutting blade moves, in particular in a rotating and/or revolving manner. The slicing apparatus furthermore comprises at least one work unit for the at least time-wise handling of the product which is active as an abutment for the front product end in a blocking position, with the work unit located in the blocking position being configured as resilient with respect to a force applied in the conveying direction.

The work unit is thus in particular not rigid. This can, for example, be realized by an elastic and/or flexible material, e.g. by a rubber material or plastic material. Alternatively or additionally, spring systems or pneumatic and/or hydraulic systems are conceivable, for example. The work unit can in this respect yield uniformly or can be adjusted stepwise—in particular in dependence on the applied force—into different positions. The yield behavior can in this respect in particular be adjustable, e.g. by the material selection, the selection of the spring used or by an adjustment or control or regulation of the pneumatic and/or hydraulic system. It can thereby be regulated whether or by how much the work unit yields in dependence on an acting force.

Alternatively or additionally, the work unit located in the blocking position is movable with a component in the conveying direction, in particular against the action of a holding force, by a force which exceeds a threshold and which is applied in the conveying direction.

From a specific force action onward, the path for the product is thus released a little in the conveying direction. In this respect, spring systems or pneumatic and/or hydraulic systems are conceivable, for example. The work unit can in this respect be moved uniformly or can be adjusted stepwise—in particular in dependence on the applied force—into different positions.

The threshold value and/or the holding force are in particular adjustable. The resistance can e.g. thereby be determined which is opposed to a product. If the pressure is sufficiently high, the blocking position is at least partly or temporarily released and the work unit at least partly releases the path for the product.

In accordance with a further embodiment, the product feed is configured with multiple tracks to slice a plurality of products simultaneously. In this respect, the work unit can be operated individually per track.

Longer products are in particular clamped between the work unit, which is located in the blocking position and which is e.g. held in said blocking position with a specific holding force, and the product holders when a plurality of products of different lengths are brought into engagement with product holders of which at least one, in particular all, are only moved in common, i.e. not individually per track. Since now at least one component of the work unit can move in the conveying direction or due to the yield, a pressurized product can in particular relax. An excessive load of the product end at the product holder is thereby largely avoided. The product is also immediately securely held. Products of different lengths can thus be processed in a simple and secure manner. In addition, there are no disadvantageous compressions of the products. Thanks to these measures, each product so-to-say individually receives as much space as it requires due to its length in order not to be compressed by an excessive amount.

In accordance with a further embodiment, the work unit comprises an adjustable holding section for each track which exerts a blocking function for the product in a blocking position, with the holding sections being operable independently of one another. In this manner, in particular the yielding behavior, the threshold value and/or the holding force can be set individually per track. These values are preferably selected as approximately the same. The holding section yields sooner or later in dependence on e.g. the length and/or consistence of the respective product and thus releases the path for the product in the direction of the cutting plane at least in part or a little.

In accordance with a further embodiment, the work unit is configured as multifunctional, with the work unit being adjustable into a contact position, in which the work unit presses the product which is movable in the conveying direction in this respect toward a lower product support and/or toward a lateral product support, and into the blocking position in which the work unit acts against a movement of the product in the conveying direction.

The invention moreover relates to a method of slicing food products, in particular by means of an apparatus in accordance with the invention, in which at least one product is fed by means of a product feed which comprises at least one conveying device, to a cutting plane in which at least one cutting blade moves, in particular in a rotating and/or revolving manner. In this respect, at least one multifunctional work unit is adjusted in dependence on the operating situation into a contact position, in which the work unit presses the product moving in the conveying direction toward a lower product support and/or toward a lateral product contact, or into a blocking position in which the work unit counteracts a movement of the product in the conveying direction.

In accordance with an embodiment, the work unit is adjusted into the blocking position before the start of slicing in order to serve as an abutment for the front product end on an action on the rear product end by means of a product holder of the conveying device. The front product end in this respect, for example, abuts the abutment, while the product holder engages at the rear product end. The product is thus not displaced in the direction of the cutting plane during the engagement of the product holder. Subsequently, in particular as soon as the product holder is in engagement with the product, the work unit is adjusted into the contact position to press the product toward the product support and/or toward the product contact during the slicing. In the contact position, the work unit acts as a product downholder, for example. The work unit can in this respect, for example, be configured as an active conveyor to convey the product to the cutting blade or at least to assist the conveying.

After the slicing, the work unit is again adjusted back into the blocking position in order in particular to prevent the product end from falling into the cutting plane when the product holder is removed from the rear product end. The work unit can also at least assist a discarding of a product end in the blocking position. The work unit can for this purpose, for example, have a vertically or obliquely extending passive surface to deflect the product end piece. Alternatively or additionally, the work unit can be actively driven in the blocking position to accelerate the discarding of the product end piece.

In accordance with a further embodiment, the work unit is in particular in permanent contact with the product, i.e. the work unit in particular constantly contacts the product, at least during an adjustment movement from the blocking position into the contact position and vice versa. The movement of the product and the adjustment movement of the work unit are in particular coordinated with one another. The product can thus be securely guided at all times.

In accordance with a further embodiment, the product is fed to the cutting plane during an adjustment movement of the work unit from the blocking position into the contact position. The feed of the product can take place, for example, with the aid of a conveyor belt, in particular arranged beneath the product, and/or with the aid of a product holder. The force which is exerted on the work unit on the feeding of the product to the cutting plane can in this respect be at least partly used to adjust the work unit from the blocking position into the contact position.

In accordance with a further embodiment, the product holder remains in its position or is moved in the conveying direction during an adjustment movement of the work unit from the blocking position into the contact position. Since the adjustment movement from the blocking position into the contact position preferably takes place with a component in the conveying direction, the product and/or the product holder can move permanently in the conveying direction. A movement of the product holder against the conveying direction is thus not necessary. The product therefore does not first have to be withdrawn to adjust the work unit from the blocking position into the contact position. The product conveying is thereby not unnecessarily interrupted. The product loading time is thereby reduced and the slicing process thus becomes faster overall.

In accordance with a further embodiment, the product holder is moved against the conveying direction during the adjustment movement of the work unit from the contact position into the blocking position. In this respect, a product end piece can in particular be withdrawn with the aid of the product holder so that the work unit can be adjusted into the blocking position and can in this respect move in front of the product holder—viewed in the conveying direction. The product holder can subsequently be released and the product end piece can be removed by the work unit or at least with the assistance of the work unit.

Irrespectively of whether a single-track or multi-track embodiment is provided, the product support is configured in two parts in a possible embodiment and comprises a rear support section which is in particular pivotable for a loading operation and comprises a front stationary support section which reaches up to the cutting plane. Both support sections are preferably configured as active conveyors, with a passive configuration also being possible, however. The work unit cooperates with the front support section in the contact position. In this respect, all combinations of active and passive embodiments are conceivable, i.e. the work unit can be configured both as a passive downholder and as an active conveyor which cooperates with a passive or likewise actively conveying front support section. If both the work unit and the front support section are active, they together form a traction system for the product which is hereby guided particularly precisely to the cutting plane.

In a further embodiment, the work unit can be equipped with guide devices for the or each product which in particular provide a secure, track-stable conveying of the or each product for the front product region on the product transport from the blocking position into the contact position. The guide devices can e.g. be provided for each track in the form of a contour which is adapted to the product cross-section and which is formed at the work unit.

Figure 2:
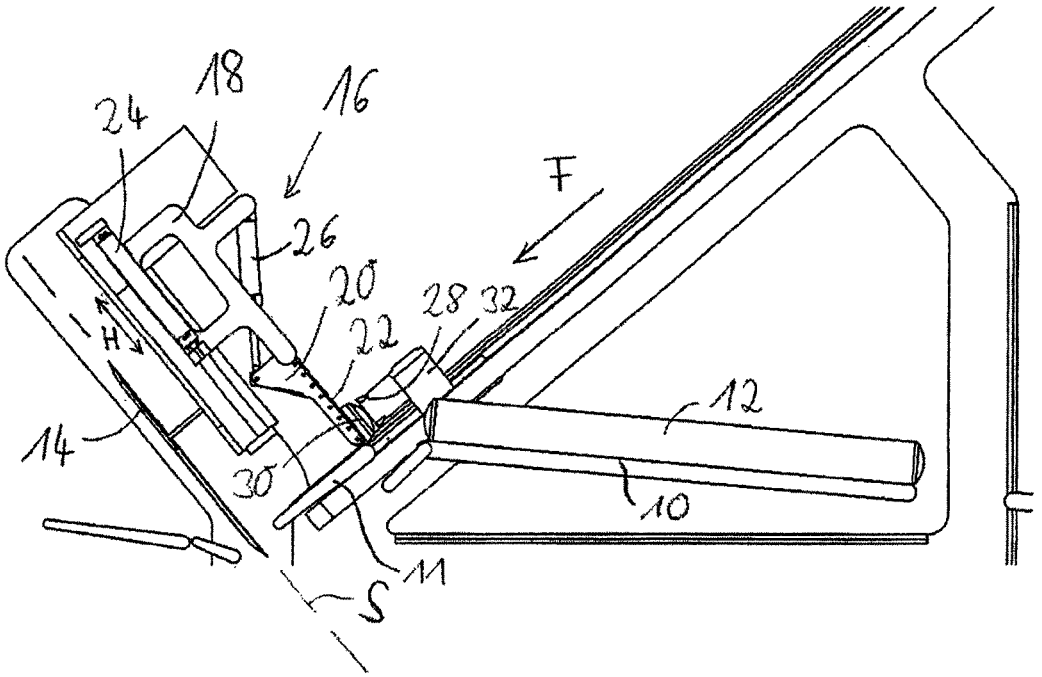
Figure 3:
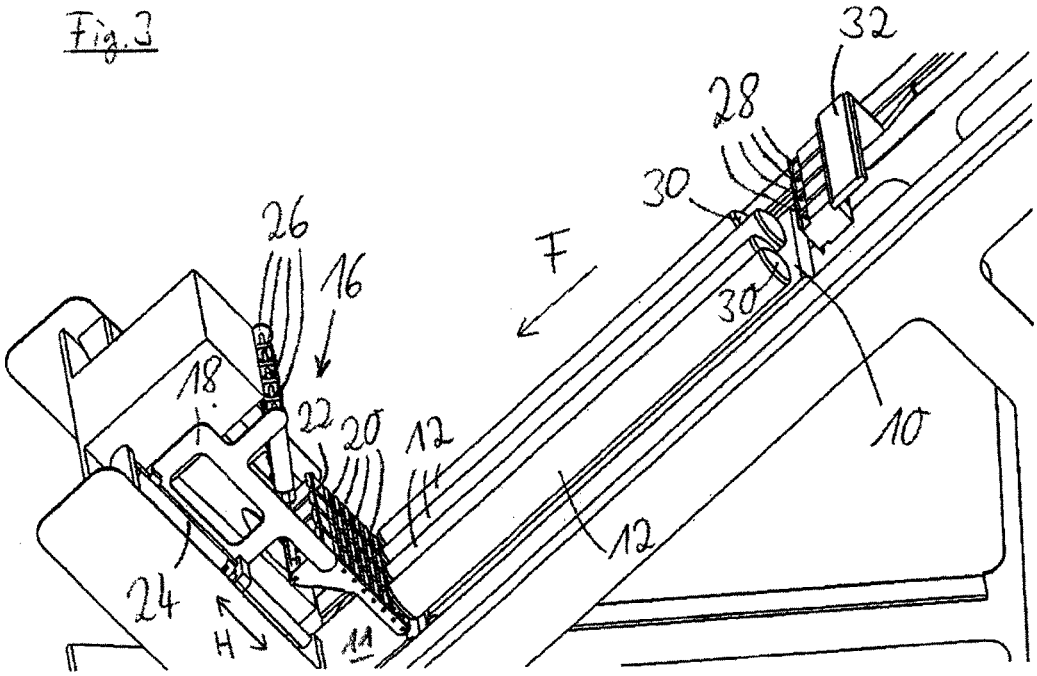
Figure 4:
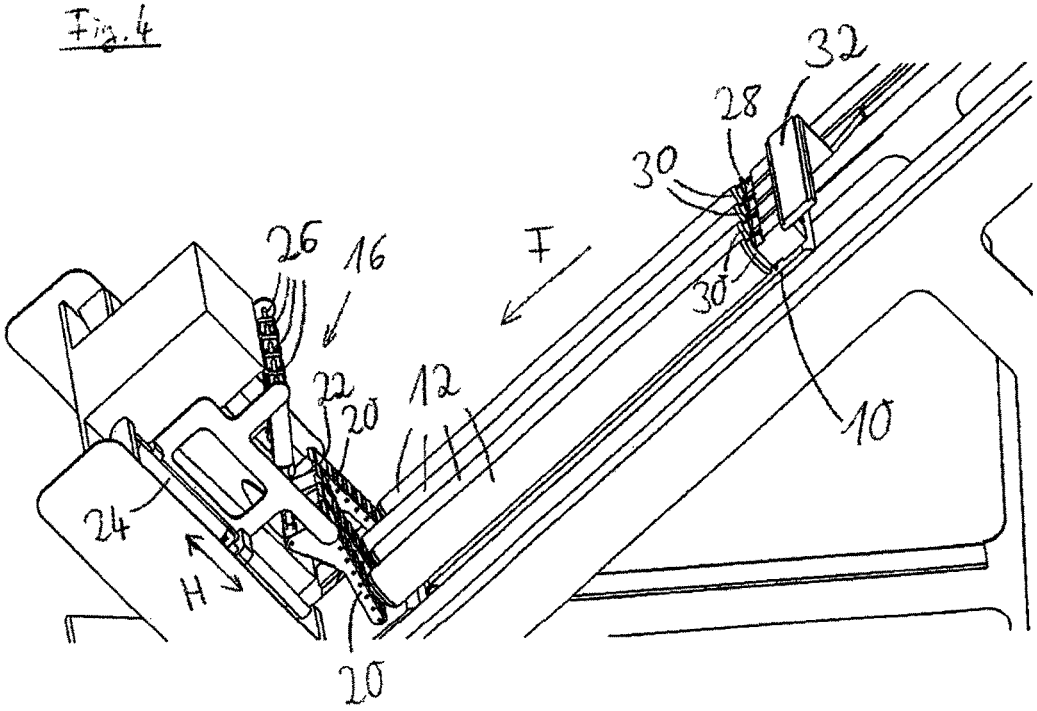
Figure 5:
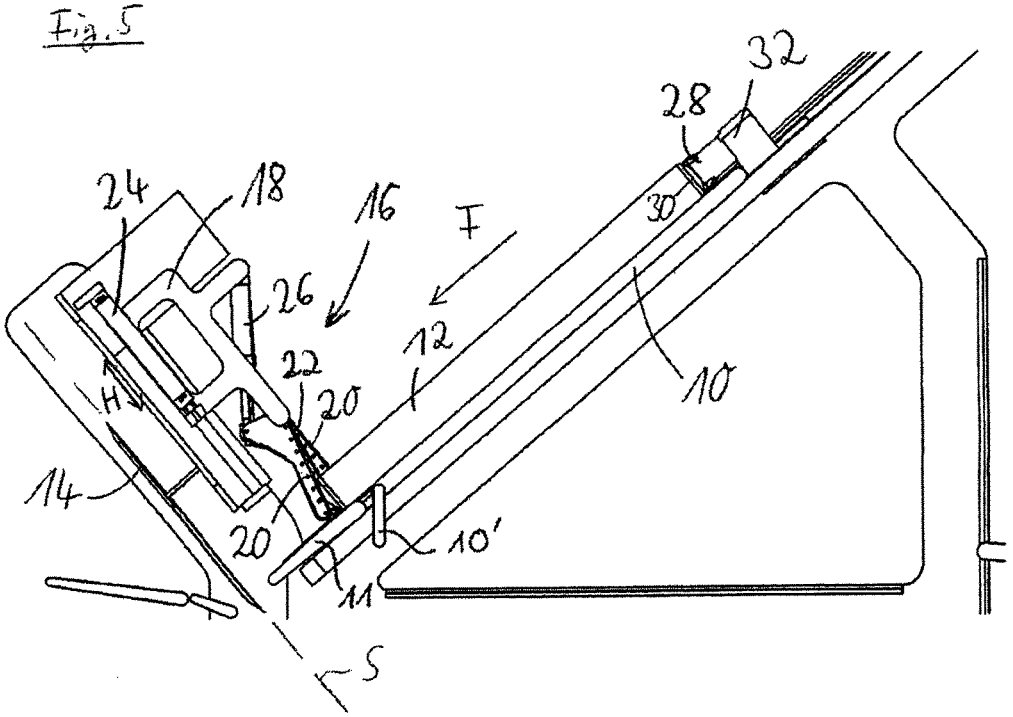
Figure 6:
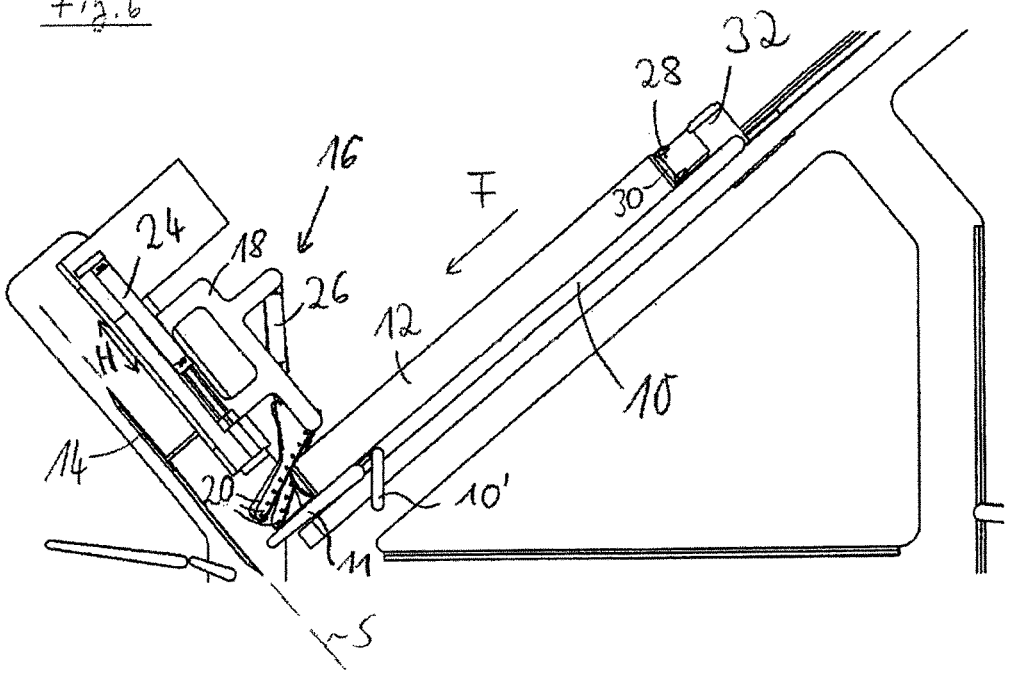

The invention will be described in the following by way of example with reference to the drawings. There are shown:

FIG. 1 a side view of an embodiment of a slicing apparatus in accordance with the invention with a work unit in the contact position;

FIG. 2 a slicing apparatus in accordance with FIG. 1 with the work unit in a blocking position;

FIG. 3 a perspective view of the slicing apparatus in accordance with FIG. 1 with newly loaded products;

FIG. 4 a slicing apparatus in accordance with FIG. 3 on the transition of the work unit from the blocking position into the contact position;

FIG. 5 a side view of the slicing apparatus in accordance with FIG. 4; and FIG. 6 the slicing apparatus in accordance with FIG. 5 with products moved further forward.

FIG. 1 shows an apparatus for slicing food products in the form of a multi-track high-performance slicer having a continuous conveyer 10 which is slanted during the cutting operation, which serves as a conveying device and with which a plurality of food products 12 are fed to a cutting plane S and are sliced along a conveying direction F. The multi-track configuration of the slicer, which is not shown in the side views, in particular not of FIGS. 1 and 2, can above all be recognized in the perspective views of FIGS. 3 and 4.

The food products 12 can in particular be sausage, ham, cheese or similar products. They can be of rod shape or of bar shape and can differ in length as a result of manufacture.

A downwardly angled front part 10' which can be pivotable relative to the conveyor 10 or which can be arranged at a fixed angle to the conveyor 10 is provided at the front end of the conveyor 10. The front part 10' can likewise be configured as an active conveyor, with this, however, not being compulsory.

A stationary front conveyor 11 in the form of a continuous conveyor belt which extends up to just in front of the cutting plane S adjoins the conveyor 10 in the conveying direction F.

A cutting blade formed as a scythe-like blade 14 is arranged in the cutting plane S. In addition, the slicer comprises a work unit 16 having a base 18 and a plurality of holding elements 20 which form holding sections of the work unit 16, with one holding element 20 being provided for each track of the slicer. The holding elements 20 are orientated in parallel with the conveying direction F in the functional position of FIG. 1 and press the products 12 onto the product support formed by the stationary front conveyer 11. The holding elements 20 thus form downholders for the products 12.

In this embodiment, the holding elements 20 moreover each comprise a belt band 22 with which the products 12 can be actively moved in the conveying direction F. The conveying of the products 12 in the direction of the cutting plane S therefore takes place with the aid of the continuous conveyor belt 10 and of the front conveyor 11, of the belt bands 22 and of a plurality of product holders which are configured as grippers 28 and which each engage into a rear product end 30 of the food products 12. Alternatively, the product holders 28 can be passive in the respect that they are not themselves active as a drive for conveying the products 12 in the conveying direction F, but are only active for stabilizing the products 12 and later (cf. FIG. 2) for withdrawing the product end pieces 30 and are pulled along e.g. by the products 12 during the movement in the conveying direction F.

In the front region, the products 12 are consequently transported to the cutting plane by the active holding elements 20 and by the stationary front conveyors 11. The work unit 16 comprises a pneumatic vertical adjustment drive 24 with which the spacing of the base 18 from the front conveyor 11 can be adjusted along a vertical adjustment direction H. In addition, the work unit 16 comprises pneumatic pivot drives 26 with which the holding elements 20 can be pivoted relative to the base 18 from the contact position shown in FIG. 1 into a blocking position. A separate pivot drive 26 which comprises a piston-in-cylinder arrangement which is pivotally connected to the base 18 at one end and to the respective holding element 20 at the other end is associated with each holding element 20, with the holding elements 2 each being pivotally connected to the base 18, and indeed at a pivot axis spaced apart from the axis of engagement of the piston-in-cylinder arrangement, so that a longitudinal change of the piston-in-cylinder arrangement generates a pivot movement of the respective holding element 20.

A blocking position of the holding elements 20 is shown in FIG. 2. The holding elements 20 are in this respect orientated perpendicular to the front conveyor 11 and form a block for the product end pieces 30.

If in accordance with FIG. 1 products 12 are thus sliced, the holding elements 20 serve as downholders for the products 12. The products 12 are held by the gripper 28 during the slicing process and are conveyed with the aid of the continuous conveyor belt 10, of the front conveyor 11 and of the belt bands 22 to the scythe-like blade 14 until the products 12 are almost completely sliced. If only the product end pieces 30 remain (see FIG. 2), they are withdrawn against the conveying direction F by means of the grippers 28. At the same time, the vertical adjustment drive 24 moves the base 18 upwardly along the vertical adjustment direction H while the pivot drive 26 pivots the holding elements 20 from the contact position into the blocking position.

In FIG. 2, the holding elements 20 thus form a block for the product end pieces 30. These end pieces 30 can therefore not fall into the cutting plane S despite the oblique position of the product support when the grippers 28 are brought out of engagement with the end pieces 30 to release the end pieces 30. If the grippers 28 are no longer in engagement with the end pieces 30, the holding elements 20 consequently serves as deflectors for the end pieces 30, whereby it is ensured that the end pieces 30 do not move to the front, but rather fall downwardly through an opening, temporarily released for this purpose, in the support plane, for example into a shaft, not shown. To remove the product end pieces 30 particularly fast and in a controlled manner, the belt bands 22 of the holding elements 20 active during the cutting operation can, for example, remain activated or be activated again.

Subsequently, the grippers 28 are moved back into their starting positions so that new food products 12 already shown in FIG. 2 can be loaded into the slicing apparatus. As FIG. 2 shows, the product feed remains slanted with this slicer, with a loading device comprising the conveyor 10 being pivoted from a substantially horizontal loading position in accordance with FIG. 2, in which the products 12 to be sliced or conducted in, into the inclined cutting position in accordance with FIG. 1 for the loading of the product feed. This embodiment is, however, not compulsory and can be modified within the framework of the invention.

In FIG. 3, a perspective view of the slicing apparatus in accordance with FIG. 1 is shown with four freshly loaded products 12 which are fed to the cutting blade 14 by the common continuous conveyor belt 10 and the front conveyer 11. The grippers 28 attached to a common carrier 23 can also not be moved individually per track, but rather only together along or against the conveying direction F by the driven carrier 32.

A separate holding element 20 which each comprises a separate pivot drive 26 is associated with each track. The common vertical adjustment drive 24 which can move the base 18 together with the holding elements 20 along the vertical adjustment direction H is provided for the vertical adjustment.

In accordance with the invention, the holding elements 20 are configured as yielding independently of one another so that they can yield to the products 12 from a specific force effect onward, i.e. the path in the conveying direction F is released a little for a product 12 pressed toward the holding element 20 associated with it by means of the product holder 28 as soon as the force exceeds a predefined degree.

The products 12 can be individually relieved of pressure by this embodiment of the work unit 16 in accordance with the invention if this is necessary due to a different length of the products 12, as will be explained in more detail in the following.

If food products 12 to be sliced which have different lengths are inserted into the slicing apparatus, the front ends of the products 12 abut the respective holding element 20. The grippers 28 are moved in common along the conveying direction F until they can each engage into the rear product end 30. With conventional slicers in this respect, a product which is longer than the other products is compressed more than the other products. Since the holding elements 20 have a specific yield, they therefore yield from a specific force effect onto the holding elements 20 onward so that a comparatively short product 12 can also be reliably gripped without a longer product 12 being excessively compressed.

This situation is shown in FIGS. 4 and 5. The holding elements 20 which are associated with longer products 12 are deflected in the conveying direction F and are thus already pivoted a little out of the original blocking position in the direction of the contact position, but without completely releasing the path for the products 12 so that a holding force is still active by which the deflected holding elements 20 also continue to oppose the respective products 12 with a resistance to ensure an engagement of the product holders 28 in accordance with their intended purpose.

The individual yield of the holding elements 20 is realized by the pneumatic devices of the pivot drives 26 which are active in the manner of a spring and which are independent of one another. The yield behavior of the holding elements 20 can be set at the pneumatic pivot drives 26 or in another manner. The setting takes place in a manner such that, one the one hand, a sufficiently large force is set against the products 12 that the grippers 28 can engage into the rear product ends 30, whereas, on the other hand, the holding elements 20 yield before the products 12 are compressed too much.

As soon as the grippers 28 are in engagement with the rear product ends 30, the holding elements 20 are pivoted further out of the blocking position into the contact position by means of the pivot drives 26 (FIG. 6). The holding elements 20 are in this respect in constant contact with the products 12. In addition, the base 18 is moved downwardly with the aid of the vertical adjustment drive 24. During the adjustment movement, the products 12 are conveyed in the conveying direction F to the cutting plane S with the aid of the continuous conveyor belt 10, of the front conveyor 11 and of the grippers 28.

Whereas the holding elements 20 can yield or be deflected individually independently of one another and thus in dependence on the respective product 12 or on the force applied via the product 12, the subsequent adjustment into the contact position takes place to initiate the cutting operation (and later also the restoration from the contact position into the blocking position) for all holding elements 20 together. Consequently only a single common active drive is required for the individual pivot drives 26 of the holding elements 20. In accordance with the invention, it is, however, not precluded that each pivot drive 26 can be controlled separately and can be operated independently of the respective other pivot drives 26 so that the holding elements 20 cannot only yield individually, but can additionally also be adjusted as desired individually.

The food products 12 are already located closer to the cutting plane S in FIG. 6. The holding elements 20 are in this respect already almost pivoted into the contact position.

The adjustment movement of the holding elements 20 on the engagement of the grippers 28 in accordance with FIGS. 4 and 5 thus already forms a part of the adjustment movement of the holding elements 20 from the blocking position into the contact position.

On the transition from the cutting preparation to the cutting operation, blocking elements so-to-say become downholders, and indeed in each case by a simple pivot movement.

If the holding elements 20 are located in the contact position, the products 12 are conveyed further along the conveying direction F until they move into the cutting plane and the slicing operation starts (cf. FIG. 1).

The work unit 16 is thus multifunctional and serves as a product abutment in the preparation of the slicing operation, as a product downholder during the slicing and as an end piece deflector at the end of the slicing process, with moreover in the case of an active embodiment, the work unit 16 also satisfying a conveying function simultaneously with the downholder function to transport the or each product 12 to the cutting plane S, and indeed together with the active front conveyer 11 which can alternatively also be passive and can only serve as a product support.

REFERENCE NUMERAL LIST

10 continuous conveyor belt, conveying device
10' front part of the continuous conveyor belt
11 stationary front conveyor
12 food product
14 cutting blade
16 work unit
18 base
20 holding element, holding section
22 belt band
24 vertical adjustment drive
26 pivot drive
28 product holder, gripper
30 product end piece
32 carrier
F conveying direction
S cutting plane
H vertical adjustment direction

The invention claimed is:

1. An apparatus for slicing food products comprising a product feed having at least one conveying device for feeding at least one product to a cutting plane defined by movement of at least one cutting blade;

a product support comprising at least one of a lower product support and a lateral product support;

at least one multifunctional work unit for handling of the product, wherein the work unit is adjustable into a contact position, in the contact position the work unit pressing the product against the product support while the product is movable in a conveying direction, the work unit adjustable into a blocking position, the work unit preventing movement of the product in the conveying direction in the blocking position, the work unit positioned as an abutment for a front end of the product in the blocking position; and a drive operatively coupled to the work unit for adjusting the work unit between the blocking position and the contact position.

2. The apparatus in accordance with claim 1,
wherein the work unit located in the blocking position is active as a deflector for a product end piece to be discarded.

3. The apparatus in accordance with claim 1,
in which the work unit is adjustable from the blocking position directly into the contact position and vice versa.

4. The apparatus in accordance with claim 1,
wherein the work unit is adjustable away from the blocking position without a component of movement directed against the conveying direction.

5. The apparatus in accordance with claim 4,
wherein the work unit is adjustable, starting from the blocking position, with a component of movement in the conveying direction into a position which clears the path for the product.

6. The apparatus in accordance with claim 1,
wherein an adjustment movement of the work unit comprises a pivot movement.

7. The apparatus in accordance with claim 1,
in which the work unit comprises at least one adjustable holding section which exerts a contact function in the contact position and a blocking function for the product in the blocking position.

8. The apparatus in accordance with claim 7,
wherein the holding section has a holding surface, the holding surface being planar and facing the product.

9. The apparatus in accordance with claim 1,
in which the position of the work unit can be varied.

10. The apparatus in accordance with claim 1,
in which an adjustment movement of the work unit and a movement for varying the position of the work unit are independent of one another.

11. The apparatus in accordance with claim 1,
in which the work unit comprises a base and at the base a holding section for the product, wherein the position of the base is variable and the holding section is adjustable.

12. The apparatus in accordance with claim 11,
in which the holding section is movable relative to the base.

13. The apparatus in accordance with claim 11,
in which a movement of the base to vary the position and an adjustment movement of the holding section can be effected independently of one another.

14. The apparatus in accordance with claim 11,
in which a movement for varying the position of the base and an adjustment movement of the holding section can be derived from a single movement of the work unit.

15. The apparatus in accordance with claim 1,
in which the work unit is configured as temporary effective drive for the product.

16. The apparatus in accordance with claim 1,
in which the product feed is of multi-track design to slice a plurality of products simultaneously, wherein the work unit is operable individually per track.

17. The apparatus in accordance with claim 16,
in which the work unit comprises an adjustable holding section for each track each adjustable holding section exerting a contact function in the contact position and a blocking function for the product in the blocking position, wherein the holding sections are operable independently of one another.

18. The apparatus in accordance with claim 17,
in which the holding sections are attached to a common base of the work unit and are adjustable relative to the base independently of one another.

19. The apparatus in accordance with claim 18,
in which a position of the base is variable.

20. An apparatus for slicing food products comprising
a product feed having at least one conveying device for feeding at least one product to a cutting plane defined by movement of at least one cutting blade; and
at least one work unit for handling of the product, the work unit acting as an abutment for a front end of the product in a blocking position,
a product holder engageable with a rear region of the product to hold the product at least during feeding to the cutting plane,
wherein the work unit located in the blocking position is moveable in response to a force applied to the work unit in the conveying direction with the front end of the product when the product holder engages the rear region of the product, the work unit preventing movement of the product to the cutting plane up to a threshold force applied to the work unit in a conveying direction with the front end of the product, the product feed being a multi-track design to slice a plurality of products simultaneously, the work unit comprising a plurality of adjustable holding sections, each track of the multi-track design having an adjustable holding section independently adjustable of the other adjustable holding sections, each adjustable holding section exerting a blocking function for the product in the blocking position to abut the front end of the product and prevent movement of the product to the cutting plane up to the threshold force.

21. The apparatus in accordance with claim 20,
in which the work unit is multifunctional, wherein the work unit is adjustable into a contact position, in which the work unit presses the product against a lower product support and/or against a lateral product support while the product is movable in the conveying direction, the work unit adjustable into the blocking position.

* * * * *